United States Patent [19]

Stahlhut

[11] Patent Number: 4,493,171

[45] Date of Patent: Jan. 15, 1985

[54] MONOLITHIC CEILING MODULES AND CEILING SYSTEM

[75] Inventor: Leo G. Stahlhut, Kirkwood, Mo.

[73] Assignee: Emerson Electric Co., St. Louis, Mo.

[21] Appl. No.: 244,228

[22] Filed: Mar. 16, 1981

[51] Int. Cl.[3] ..... E04B 5/52; F21V 21/02

[52] U.S. Cl. ..... 52/28; 52/204; 52/802; 362/150

[58] Field of Search ..... 52/145, 475, 476, 28, 52/802, 204; 362/147, 148, 150, 149

[56] References Cited

U.S. PATENT DOCUMENTS

| | | | |
|---|---|---|---|
| 2,982,196 | 5/1961 | Sherron | 52/28 |
| 3,372,270 | 3/1968 | Quin | 362/149 |
| 3,736,706 | 6/1973 | Stephenson | 52/28 |
| 3,743,826 | 7/1973 | Halfaker | 362/149 |
| 3,831,019 | 8/1974 | Halfaker | 52/28 |
| 4,114,327 | 9/1978 | Williams | 52/28 |
| 4,175,360 | 11/1979 | Mulvey | 52/28 |

*Primary Examiner*—John E. Murtagh

*Attorney, Agent, or Firm*—Polster, Polster and Lucchesi

[57] ABSTRACT

A ceiling module includes a ceiling-defining sheet of material and an overlay spaced above and parallel with the ceiling-defining sheet. The overlay is secured to the ceiling-defining sheet along the periphery of the ceiling-defining sheet and also at positions spaced inwardly from the periphery to support the ceiling-defining sheet.

13 Claims, 13 Drawing Figures

MONOLITHIC CEILING MODULES AND CEILING SYSTEM

BACKGROUND OF THE INVENTION

This invention relates to a ceiling module and a ceiling system including such modules. It relates particularly to such a module and system in which the modules are lighter and more easily transported than those previously known, while providing a planar ceiling.

Ceiling modules are now well known. Such modules are of substantial size, on the order of ten to thirty-six square feet in area (one to two meters on a side), and are easily arranged as repeating ceiling elements to form a modular ceiling. Examples of such modules and ceilings are shown and described, for example, in Quin et al, U.S. Pat. No. 3,372,270, in Halfaker, U.S. Pat. No. 3,743,826, and in Halfaker et al., U.S. Pat. No. 3,831,019.

In all of these modules, a ceiling surface is defined by four sheet-metal panels arranged to form a rectangular ceiling area having a central rectangular opening. The ceiling-defining panels have upwardly turned edges at the periphery of the module and at the central opening. A lighting fixture including a light source may be mounted in the central opening. Also, batts of sound-deadening material may be placed over the ceiling-defining panels, and metal sound attenuating panels may be placed over the batts. In all of these modules, the support for the ceiling-defining panels is a generally vertical frame means extending along and above lines of joinder between the ceiling-defining panels.

Such ceiling modules have made possible truly integrated ceiling systems in which lighting, air handling, sound attenuation and flexible partitioning are combined in a modular ceiling structure.

In recent years, energy considerations have dictated that a substantial proportion of the modules in a modular ceiling be unlighted. It would therefore be desirable to produce ceiling modules which did not require the bulky frame and lighting fixture of previously known systems. It would also be desirable to produce ceiling modules which were truly monolithic in appearance, with a single ceiling-defining panel for each module, rather than the four panels required by presently known constructions.

SUMMARY OF THE INVENTION

One of the objects of this invention is to provide a ceiling module which requires only a single ceiling-defining panel.

Another object is to provide such a module which does not require bulky vertical spine members for support of the module.

Another object is to provide such a module in which the ceiling-defining panel may be planar, rather than pyramidal.

Another object is to provide a modular ceiling utilizing such modules, especially such a ceiling in which a substantial proportion of the modules do not carry lighting fixtures or lamp housings.

Other objects will occur to those skilled in the art in light of the following description and accompanying drawings.

In accordance with this invention, generally stated, a ceiling module is provided comprising ceiling-defining means for defining a rectangular ceiling area, visible from below, and frame means, generally above the ceiling-defining means, for supporting the ceiling-defining means, the ceiling module being characterized in that the major portion of the ceiling-defining means is a single sheet of material and in that the frame means comprise at least one panel of sheet material forming a rectangular overlay above the ceiling-defining means, the overlay being generally parallel with and spaced above the ceiling-defining means, the overlay being secured to the ceiling-defining means along the periphery of the ceiling-defining means and also at positions spaced inwardly from the periphery of the ceiling-defining means. Together, the rectangular ceiling-defining panel and the rectangular overlay form a rigid, self-supporting ceiling-defining portion of the module.

Preferably, the frame means comprise four upper panels secured to each other to form the rectangular overlay. The upper panels also form a central rectangular opening in the overlay. The overlay has a peripheral down-turned margin and a down-turned margin around the central opening, both the down-turned margins being secured to the ceiling-defining means. The four panels are preferably identical and are arranged with one short end to a long side of an adjacent panel in the manner of a pinwheel. Preferably, the ceiling-defining panel has a peripheral upturned edge, secured to the peripheral down-turned edge of the overlay. In the preferred embodiment, the peripheral up-turned margin of the ceiling-defining panel and the peripheral down-turned margin of the overlay both include shoulders which form an interference fit.

Preferably, the ceiling-defining panel and the four panels forming the overlay are made of sheet metal.

In at least some of the modules making up a ceiling system, the ceiling-defining means also forms a central rectangular opening in the ceiling area, the ceiling area having a peripheral up-turned margin and an up-turned margin around the central opening, both the up-turned margins being secured to the down-turned margins of the overlay. A central panel is mounted in the opening.

Preferably, the modules are square and have a side of from one to two meters. The central opening preferably has an area no more than half the area of the module.

In some of the modules the central panel is a light-transmitting panel, and a lighting fixture is mounted above the central opening. In these modules a fixture-supporting frame may extend from the fixture substantially to the periphery of the module. Preferably, the fixture-supporting frame comprises four identical frame pieces arranged end-to-side in a pinwheel fashion and includes means at the distal ends of the frame pieces for engaging the means for suspending the module. The gauge of the sheet metal forming the ceiling-defining portion of the module may also be chosen to be sufficient to support the fixture without the use of a separate fixture-supporting frame.

In others of the modules, the central panel may be a sheet metal filler having upturned margins secured to the down-turned margins of the overlay around the central opening.

In yet other modules, the entire ceiling-defining means may be a single panel.

Preferred ceiling systems constructed of the ceiling modules of the present invention may be characterized by the fact that they include at least some modules in which a lamp housing having four vertical walls is formed by four interlocking strips of material overlying and separate from a self-supporting ceiling-defining module and extending to the edges of the module. Preferably that module is a one-piece ceiling-defining panel which includes a central opening and is supported by an overlay secured to the ceiling-defining panel at its periphery and around its central opening.

Other aspects of the present invention will better be understood in light of the following description of the preferred embodiment.

DESCRIPTION OF THE PREFERRED EMBODIMENT

Figure 1:
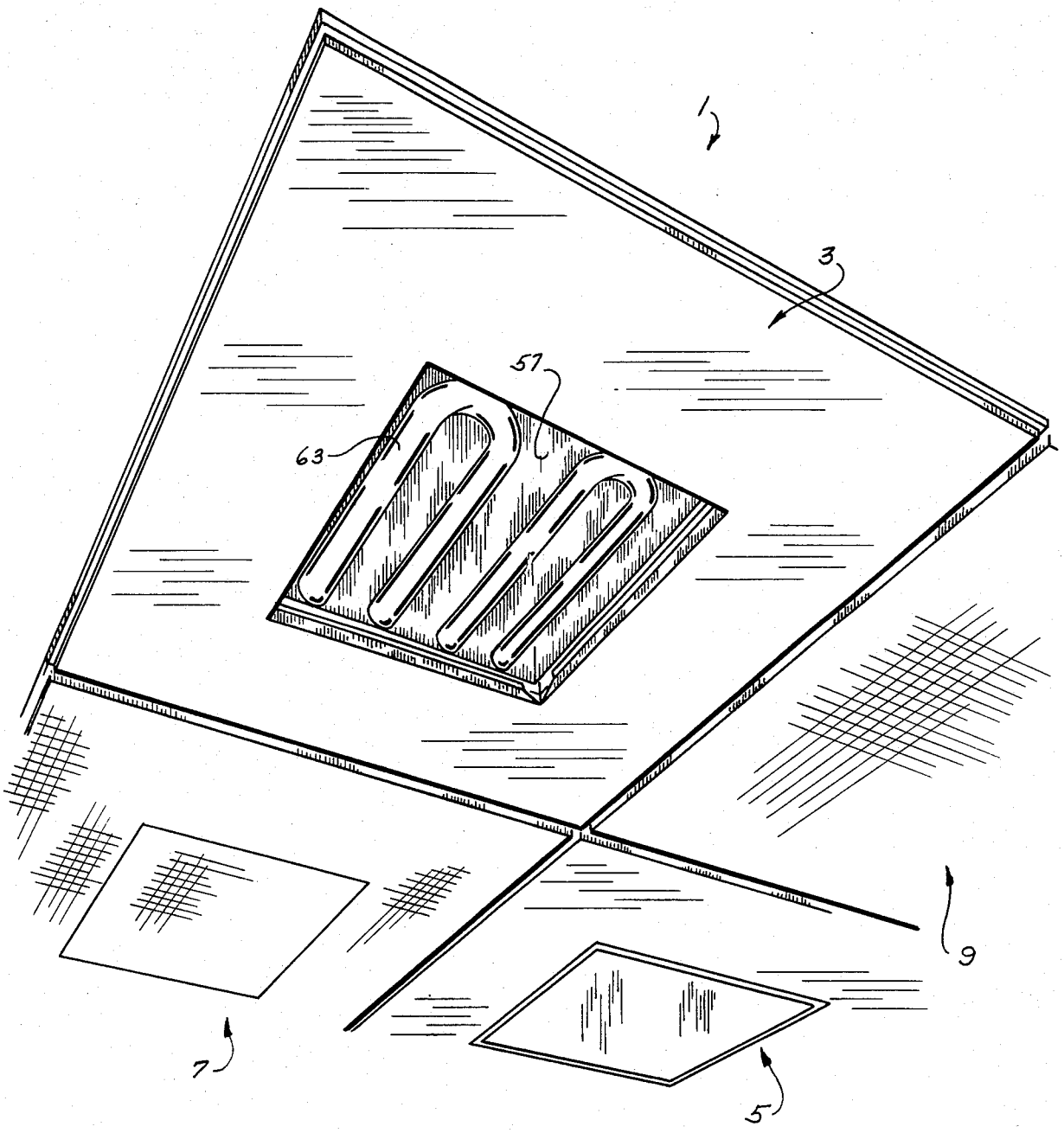
FIG. 1 is a view in perspective from below of a part of a ceiling system embodying the ceiling modules of the present invention.
Figure 2:
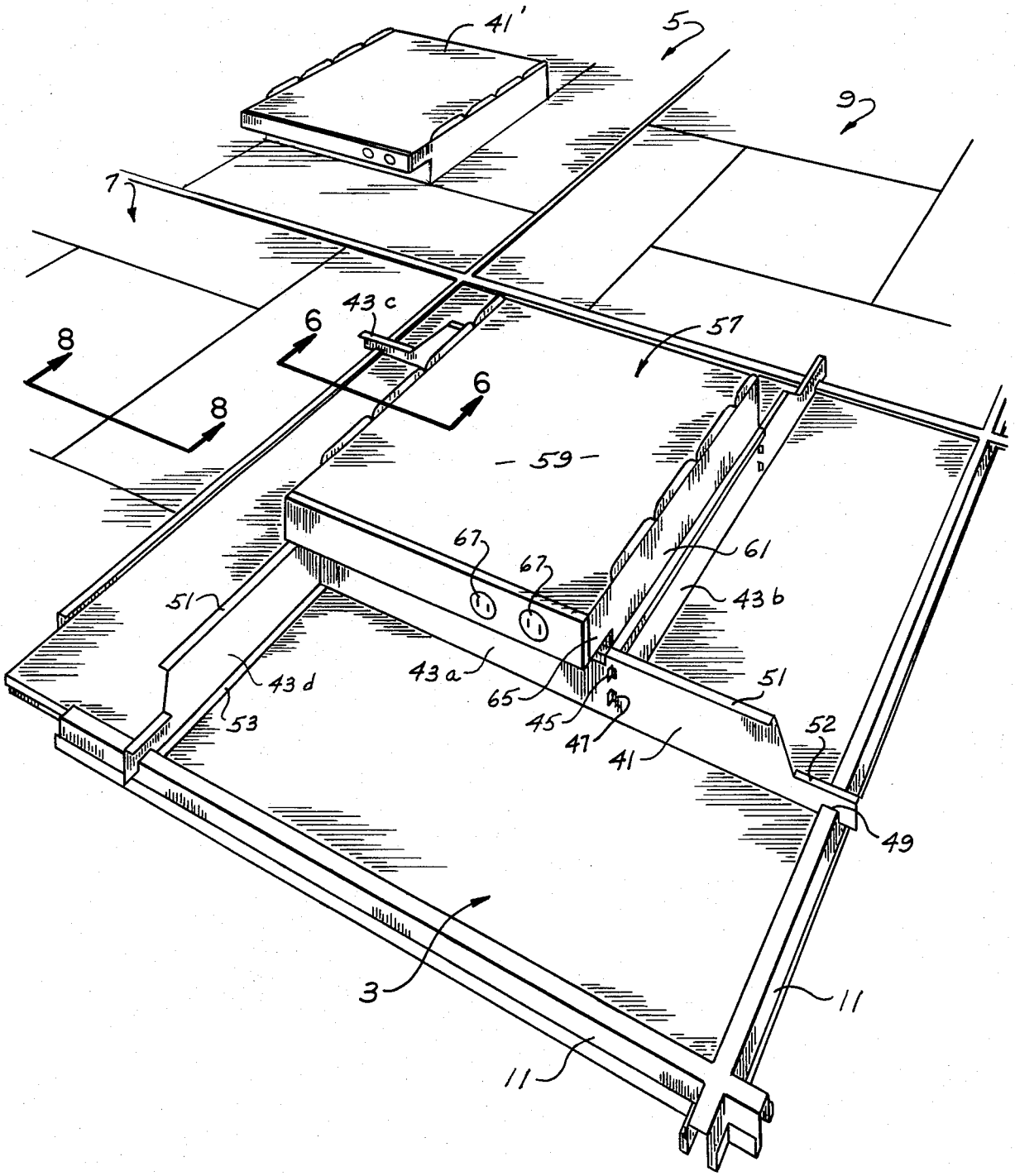
FIG. 2 is a view in perspective from above of the ceiling system of FIG. 1.

Referring now the drawings, and in particular to FIGS. 1 and 2, reference numeral 1 indicates a ceiling system of the present invention in which modules of the same size are arranged in spaced edge-to-edge relationship to form a ceiling. The ceiling system 1 of FIGS. 1 and 2 includes a lighted module 3 (shown with a central light-transmitting panel removed), a second lighted module 5, an unlighted module 7 with a central blank panel, and a second unlighted module 9 with a unitary panel defining its entire planar ceiling area.

The modules of FIGS. 1 and 2 are suspended from a support structure by means of a square lattice of intersecting linear suspension elements 11. The linear suspension elements may be those disclosed in U.S. Pat. No. 4,047,336, to the present inventor and Garnett, for example.

Figure 3:
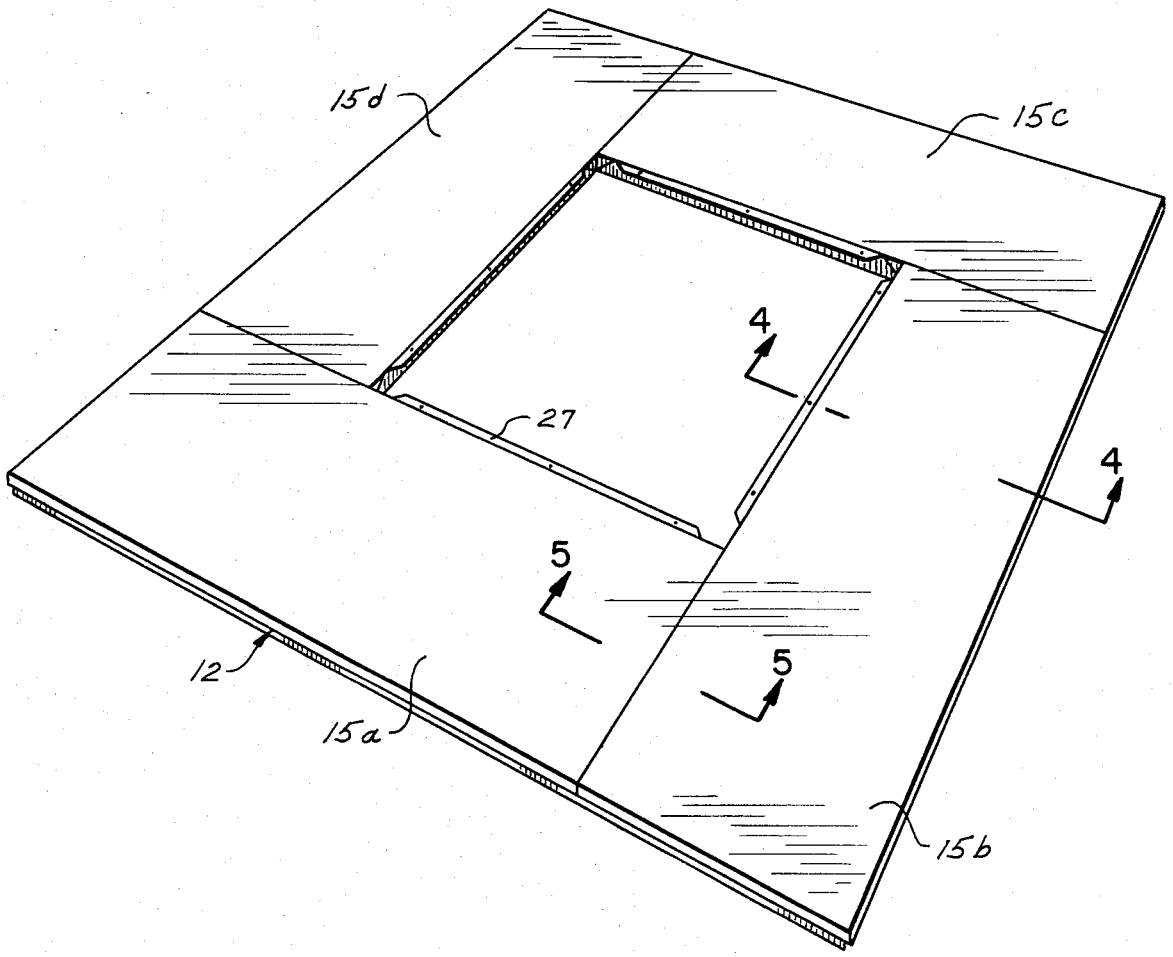
FIG. 3 is a view in perspective from above of a module of FIG. 1 with a lighting fixture removed for clarity.
Figure 4:
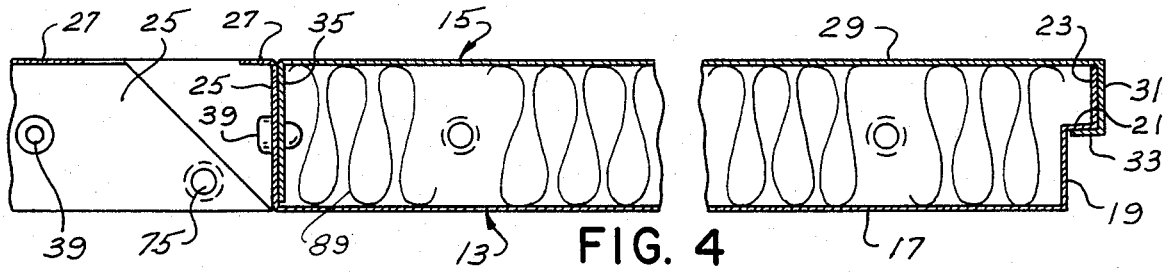
FIG. 4 is a sectional view taken along line 4—4 of FIG. 3.
Figure 5:
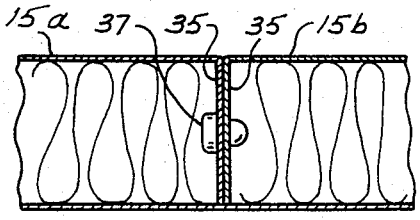
FIG. 5 is a sectional view taken along line 5—5 of FIG. 3.

As shown in FIGS. 3–5, each of the modules 3, 5 and 7 includes a self-supporting ceiling-defining portion 12 including a lower unitary ceiling-defining panel 13 and four upper panels 15*a*, 15*b*, 15*c* and 15*d* which form a support frame 16 for the ceiling-defining panel 13 as described hereinafter.

The lower unitary ceiling-defining panel 13 includes a planar wall 17 defining a square ceiling area having a central square opening 18. The wall 17 is perforated in the manner of U.S. Pat. No. 3,743,826, to Halfaker. Along each of its peripheral edges, the panel 13 includes a lower riser portion 19, an out-turned tread 21 and an upper riser portion 23. Along each edge of the central opening, the panel 13 includes an up-turned wall 25 having an inwardly turned lip 27 at its upper edge. Because the entire panel 13 is struck from a single sheet of steel, the up-turned walls 25 and in-turned lips 27 have edges which converge upwardly at a forty-five degree angle as shown in FIGS. 3 and 4.

Each of the upper panels 15 is rectangular and includes a planar upper face 29 having opposed long edges and opposed short edges. One long edge and one short edge of each upper panel 15 are formed with a down-turned riser 31 and an in-turned tread 33. The interior height of the riser 31 is substantially equal to the exterior height of the upper riser portion 23 of the ceiling-defining panel 13, and the interior width of the tread 33 is slightly less than the exterior width of the tread 21 of the ceiling-defining panel 13. The other long and short margins of each panel 15 are formed with a down-turned wall 35 of a height substantially equal to the height of the up-turned inner walls 25 of the ceiling-defining panel 13. The panels 15 are made of sheet steel, aluminum or other metal.

One short edge of each panel 15 abuts a long edge of one adjacent panel 15 and the other short edge of each panel 15 is aligned with the exterior long edge of another panel 15, so that the panels are arranged in a pinwheel, as shown in FIG. 3. The down-turned wall 35 on the long margin of each panel 15 is held by blind rivets 37 to the down-turned wall 35 of the short edge of the adjoining panel 15 before the frame 16 is assembled to the lower panel 13. FIGS. 3 and 5 show the long edge of panel 15*b* secured to the short edge of panel 15*a*. The outer margins of the panels 15, which are initially formed with down-turned riser part 31 bent only partially downward, are then pressed inwardly to cause the in-turned lip formed by tread 33 on frame 16 to fit over the shoulder formed by tread 21 on the panel 13, so that the panels 15 interlock at their exterior margins with the peripheral margin of the panel 13 to form the periphery 38 of the module. The down-turned walls 35 of the frame 16 are secured with blind rivets 39 to the up-turned walls 25 of the panel 13 around the central opening 18.

The assembled ceiling-defining portion 12 is extremely rigid and is self-supporting.

The lighted module 3 includes a fixture-supporting frame 41 consisting of four identical arms 43 arranged end-to-side in a pinwheel fashion as shown in FIG. 2. The end of each arm 43 includes a pair of tabs 45 extending through slots 47 in the broad vertical wall of the arm 43. The distance between the "tab" and of each arm 43 and the slots 47 is chosen to be substantially equal to the side of the square opening 18 of the ceiling-defining portion 12 of the module. The free end of each arm 43 is notched, as shown at 49, to receive the upper edge of the suspension element 11. The notch 49 is preferably sized in such a way that the arm 43 rests directly on the panels 15. By spreading the weight of the fixture to the edges of the module, particularly along the lines of juncture of the panels 15, the arms 43 prevent sagging of the module 3. The upper edge of each arm 43 horizontally bent stiffening flaps 51 and 52. The lower edges of the arms 43 include inwardly bent stiffening flaps 53 which are held by sheet metal screws 55 to the inwardly turned lips 27 of the ceiling-defining panel 13.

A lighting fixture 57 is mounted on the upper edge of the fixture-supporting frame 41 of module 3. The fixture 57 may be a standard one, including an upper wall 59 and four side walls 61 defining a square, open-bottomed box in which are mounted a pair of u-shaped fluorescent lamps 63. An extension 65 of the fixture 57 houses ballasts for the lamps 63 and plugs 67 for connecting the fixture 57 to a power source and to other modules 57. Outwardly and downwardly turned flanges 69 at the lower edge of the fixture 57 position the fixture 57 on the outwardly turned flaps 51 of the arms 43.

Figure 6:
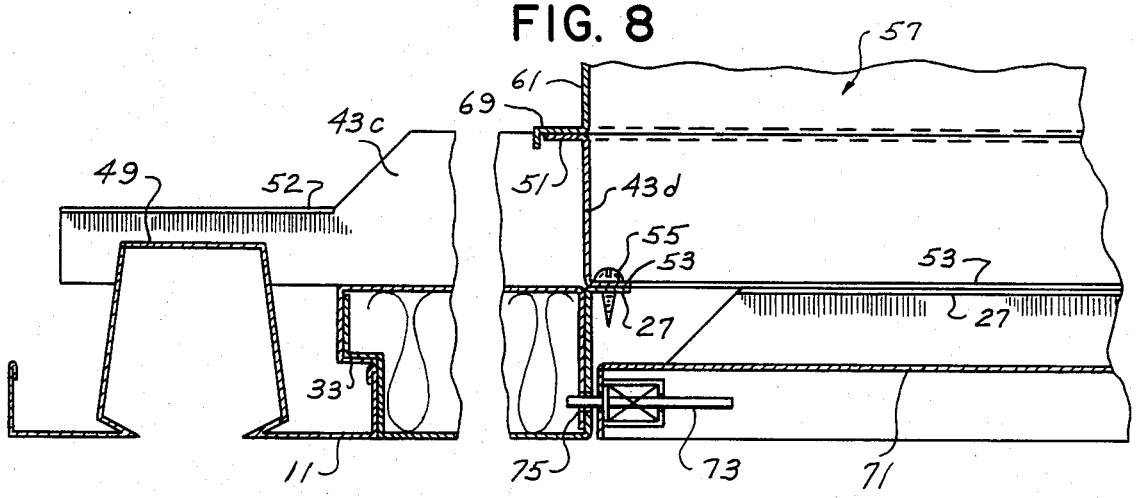
FIG. 6 is a sectional view taken along line 6—6 of FIG. 2.
Figure 7:
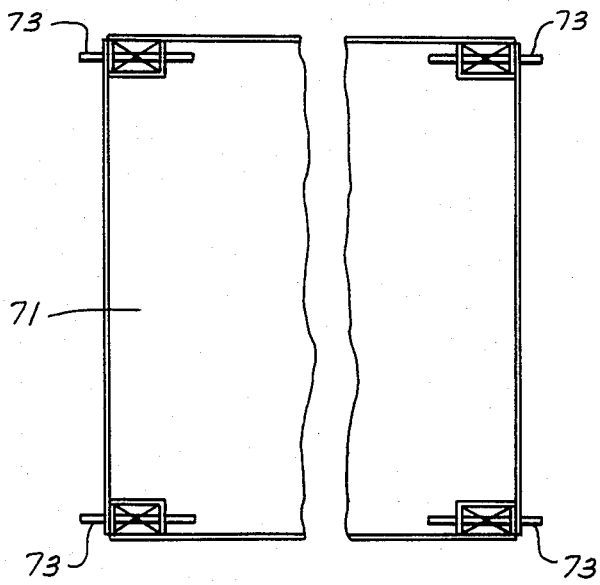
FIG. 7 is a top plan view of a central panel for use in the module of FIG. 6.

As shown in FIGS. 6 and 7, a light directing or difusing element, such as a standard prismatic panel 71, may be mounted in the central square opening 18 of the module. As shown in the figures, the panel 71 may be held by spring-loaded pins 73 at the four corners of the panel. The pins 73 are parallel to one another, so that when the pins extending into holes 75 in the central seat on one side of the panel 71 are retracted, the pins 73 on the other side of the panel 71 act as hinges.

The module 5 is formed of somewhat heavier gauge metal than the module 3, and the fixture supporting frame 41 is omitted altogether. The fixture 41' of this module is made somewhat deeper than the fixture 41 of the module 3, for providing light cut-off control, and has an inturned lip at its lower edge, for attachment to the lip 27 of the opening 18. It has been found that this arrangement provides a highly rigid and planar module, despite the weight of the fixture 41'.

Figure 8:
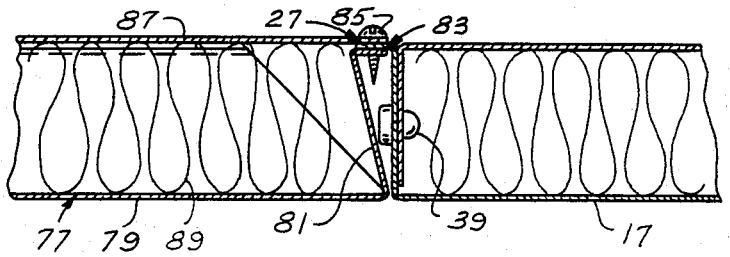
FIG. 8 is a sectional view taken along line 8—8 of FIG. 2.

As previously noted, one of the advantages of the modules of the present invention is that unlighted modules may be very compact and simple, while retaining the virtues of lighted modules, such as strength, aesthetic appearance, sound attenuation, ease of cleaning, fire resistance and so on. One such module 7 is shown in detail in FIG. 8. As shown in that FIGURE, the module 7 differs from the lighted modules 3 and 5 in that it lacks the fixture-supporting frame 41 and fixture 57. The ceiling-defining portion 12 is identical with those of modules 3 and 5. Mounted in the central seat 18 of the module 7 is a square sheet-metal pan 77. The pan 77 has a lower planar face 79, which may be perforated in the same pattern as the planar wall 17 of the ceiling-defining panel 13, and four upwardly and inwardly extending side walls 81. Outwardly turned flanges 83 at the upper edges of the side walls 81 are secured by sheet metal screws 85 to the inwardly turned lips 27 of the panel 13 around the upper periphery of the central opening 18. The edges of the side walls 81 taper upwardly inward to permit the side walls 81 to spring inwardly for clearing the rivets 39 during assembly. A flat cover plate 87 is secured to the upper face of the lip 27 by the sheet metal screws 85.

It will be seen that the construction of the module 7 allows it to be converted easily into a lighted module by the simple expedient of removing the pan 77 and the cover 87, and adding a fixture 57, together with a fixture supporting frame 41 if the weight of the fixture is sufficient to cause noticeable deflection of the ceiling-defining portion 12.

As shown in the drawings, the upper panels 15 of the ceiling-defining portion 12 and the pan 77 are filled with batts 89 of sound absorbing material such as fiberglass wool. A combination of perforations in the lower horizontal walls 17 and 79 of the module, sound absorbing batts and sound-attenuating walls 29 and 87 provides excellent attenuation of sound from below the module.

Figure 9:
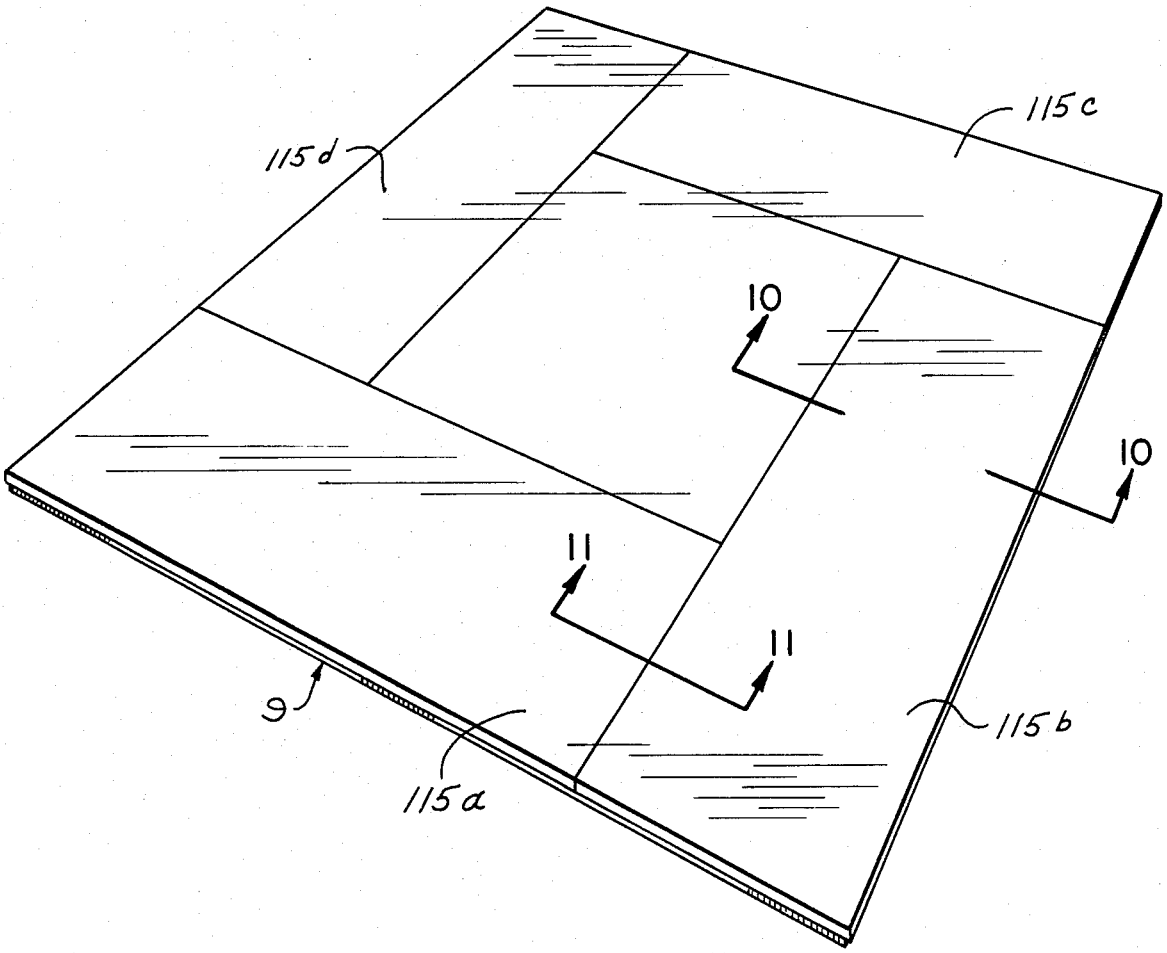
FIG. 9 is a view in perspective from above of another unlighted module of FIG. 1 having a single ceiling-defining panel without an opening for a lighting fixture.
Figure 10:
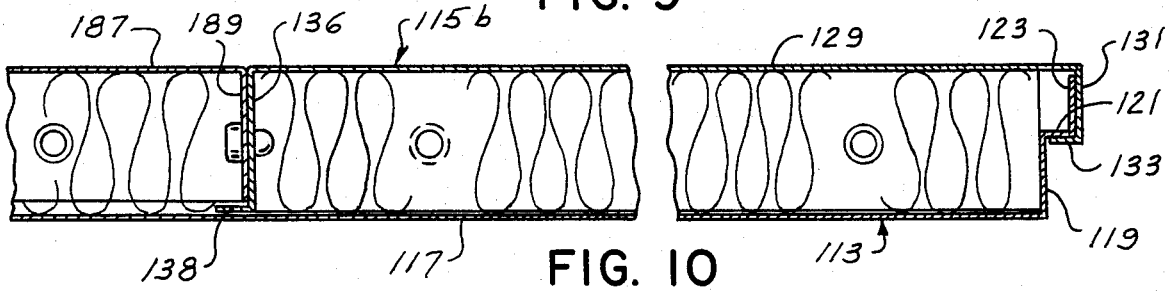
FIG. 10 is a sectional view taken along line 10—10 of FIG. 9.
Figure 11:
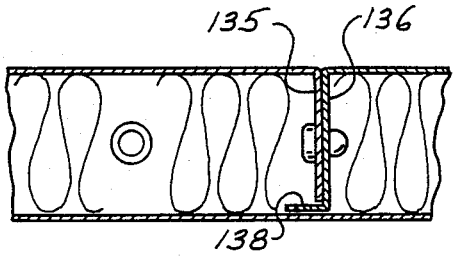
FIG. 11 is a sectional view taken along line 11—11 of FIG. 9.

In some cases it is aesthetically preferable to provide unlighted modules which have an unbroken ceiling-defining face, rather a border with a filled center as in module 7. Such a module is indicated by the numeral 9 in FIG. 1 and is shown in more detail in FIGS. 9–11. The module 9 includes a ceiling-defining panel 113 which differs from the panel 13 of the previous embodiments in that it is unbroken from edge to edge, but is otherwise identical with panel 13. In particular, it includes at its periphery a lower riser portion 119 an out-turned tread 121 and an upper riser portion 123 corresponding to the same parts of the panel 13. The module 9 also includes four upper panels 115*a–d*, each having a planar upper face 129 and, on one long edge and one short edge, a down-turned riser part 131 and an in-turned tread 133 corresponding to those parts of the upper panels 15 of the previous embodiments. The panels 115 also include a down-turned wall 135 along the other short end of each panel, a wall 135 being shorter than the wall 35 by approximately the thickness of the metal of which it is formed. The other long edge of each panel 115 includes a down-turned wall 136 having an outwardly turned foot 138 at its lower edge. The module 9 also includes a central pan 187 having down-turned walls 189 around its periphery. the down-turned walls are of the same height as the walls 135 of the panels 115.

The module 9 is assembled by riveting together the panels 115 and 187. An adhesive is applied to the bottoms of the feet 138. Batts of insulation are placed in the panels 115 and 187. The peripheral down-turned riser parts 131 of the panels 115 are spread sufficiently to position the ceiling-defining panel 113 into place and then are bent to secure the peripheries of the panel 113 and panels 115. The adhesive on the lower faces of the feet 138 adheres the feet 138 to the upper surface of wall 117 along the interior long edges of the panels 115, thereby supporting the interior portions of the panel 113 and preventing its lower wall 117 from sagging.

Figure 12:
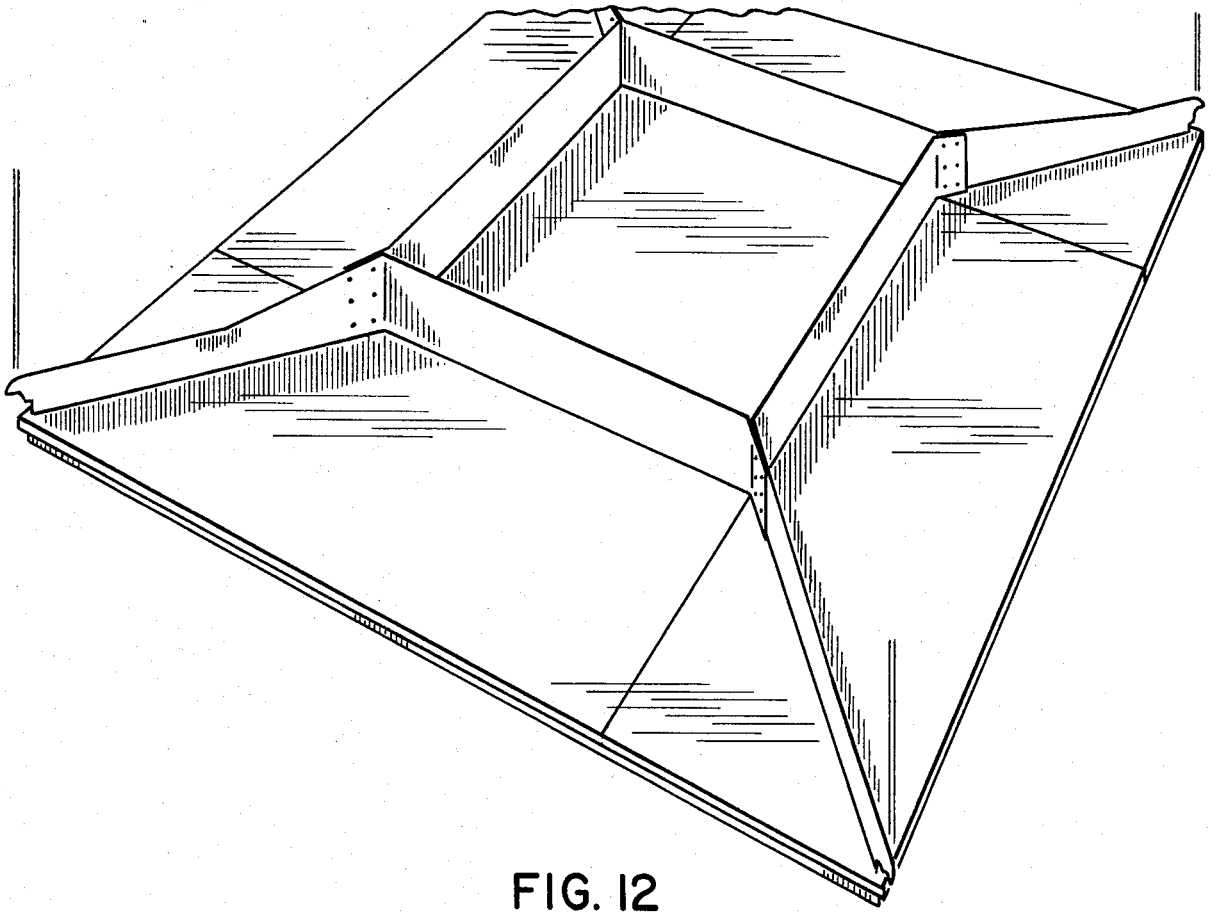
FIG. 12 is a view in perspective from above of a module of FIG. 1 showing an alternative fixture-supporting frame and an alternative means of suspending the module from a support structure.
Figure 13:
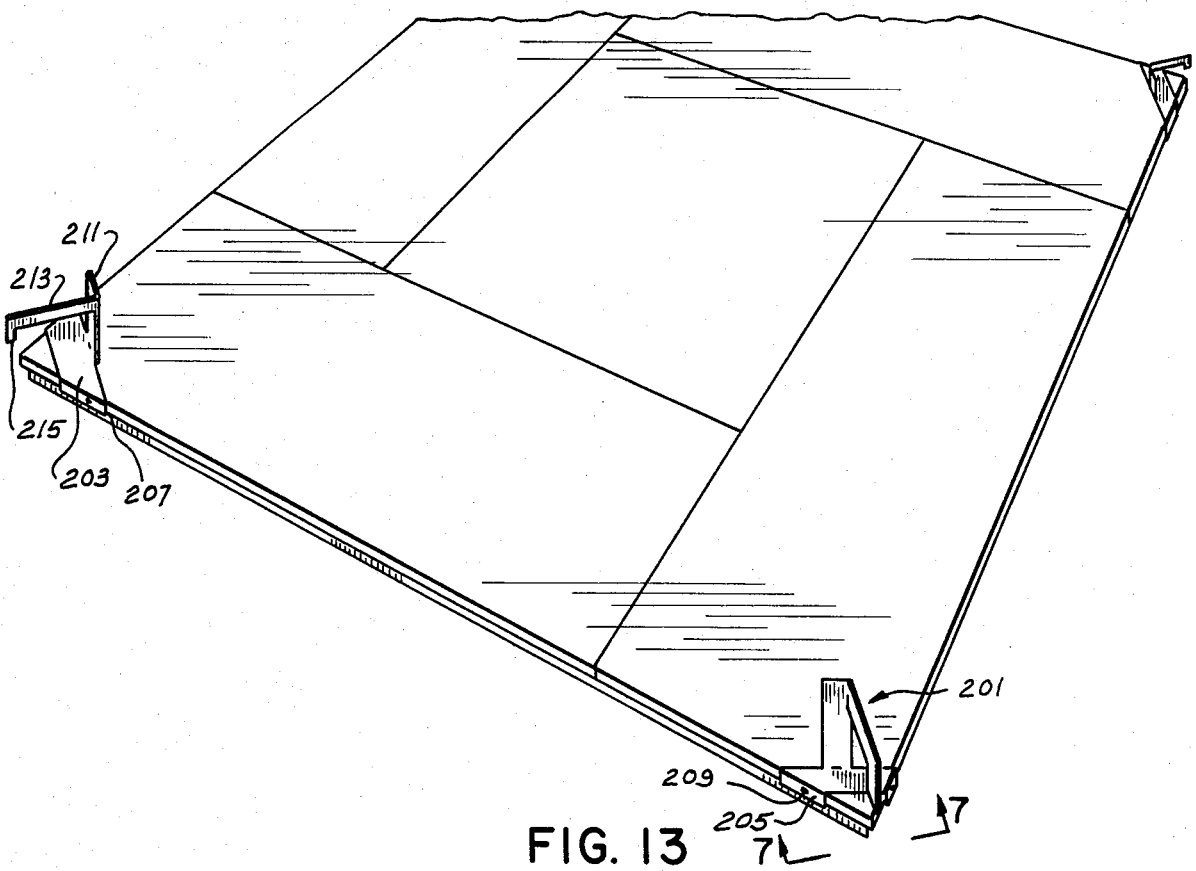
FIG. 13 is a view in perspective from above of an unlighted module of FIG. 1 showing an alternative means of suspending the module from a support structure.

Numerous variations in the module and ceiling of the present invention, within the scope of the appended claims, will occur to those skilled in the art in light of the foregoing disclosure. As shown in FIG. 12, the panels 3, 5, 7 and 9 may be supported from an overhead ceiling structure by means other than the suspension elements 11. For example, they may be supported from their corners by the hangers of Halfaker, U.S. Pat. No. 3,402,517 and may include a fixture supporting frame similar to the frame of U.S. Pat. No. 3,831,019, to Halfaker and the present inventor. Support for the modules may also be obtained by screwing hangers 201 to the corners of the modules. The hangers 201 may be bent from a single piece of sheet metal, and include a strap part 203 having bent-down edges 205 extending at 90° to each other. In-turned flanges 207 on the edges 205 engage the in-turned tread 33 of the module. Each edge 205 is held by a sheet metal screw 209 to the down-turned riser part 31 and upper part riser portion 23 of the module. An upwardly bent stanchion part 211 carries an outwardly bent arm 213 having a downwardly turned finger 215 for engaging the support means. In this embodiment, the arms 43 of the fixture support 41 may terminate at the periphery of the module, if a fixture support 41 is used.

Numerous other variations in the module of this invention, within the scope of the appended claims, will occur to those skilled in the art in light of the foregoing disclosure. For example, the in-turned treads 33 on the panels 15 may be omitted and the walls 23 and 31 may be riveted together. Other fixtures may be attached above the opening 18. The sound absorbing material 89 may be different or may be omitted. These variations are merely illustrative.

I claim:

1. A ceiling module comprising (a) ceiling-defining means for defining a rectangular ceiling area visible from below, and (b) frame means, generally above said ceiling-defining means, for supporting said ceiling-defining means, said ceiling module being characterized in that the major portion of said ceiling-defining means is a single sheet of material and in that said frame means comprise at least one panel of sheet material forming a rectangular overlay above said ceiling-defining means, said overlay being generally parallel with and spaced above said ceiling-defining means, said overlay being secured to said ceiling-defining means along the periphery of said ceiling-defining means and also at positions spaced inwardly from the peripery of said ceiling-defining means, said ceiling-defining means and said overlay forming a rigid, self-supporting ceiling-defining portion of said module without vertical support spines above said ceiling-defining portion for supporting said ceiling-defining portion wherein said frame means comprise four upper panels secured to each other to form said rectangular overlay, said upper panels also forming a central rectangular opening in said overlay, said overlay having a peripheral down-turned margin and a down-turned margin around said central opening, both said down-turned margins being secured to said ceiling-defining means.

2. The module of claim 1 wherein said ceiling-defining means have a peripheral upturned edge, secured to said peripheral down-turned edge of said overlay.

3. The module of claim 2 wherein said ceiling-defining means are made of sheet metal.

4. The module of claim 3 wherein said four panels forming said overlay are made of sheet metal.

5. The module of claim 4 wherein said ceiling-defining means also forms a central rectangular opening in said ceiling area, said ceiling area having a peripheral up-turned margin and an up-turned margin around said central opening, both said up-turned margins being secured to said down-turned margins of said overlay.

6. The module of claim 4 wherein said four panels are identical and are arranged short end to long side.

7. The module of claim 4 wherein said peripheral up-turned margin of said ceiling-defining means and said peripheral down-turned margin of said overlay each includes a generally horizontal shoulder mating with each other to form an interference fit.

8. The module of claim 5 further including a central panel in said opening.

9. The module of claim 8 wherein said central panel is a sheet metal filler having upturned margins secured to said down-turned margins of said overlay around said central opening.

10. The module of claim 8 wherein said central panel is a light-transmitting panel.

11. the module of claim 5 including a lighting fixture mounted above said central opening.

12. The module of claim 11 including a fixture-supporting frame extending from said fixture substantially to the periphery of said module.

13. The module of claim 12 wherein said fixture-supporting frame comprises four identical frame pieces arranged end-to-side in a pinwheel fashion and including means at the distal ends of said frame pieces for engaging means for suspending said module.

* * * * *

UNITED STATES PATENT AND TRADEMARK OFFICE

CERTIFICATE OF CORRECTION

PATENT NO. : 4,493,171

DATED : January 15, 1985

INVENTOR(S) : Leo G. Stahlhut

It is certified that error appears in the above—identified patent and that said Letters Patent is hereby corrected as shown below:

Col. 6, line 39 "the interior" should be "the entire length of the interior"

Col. 7, line 26 "peripery" should be "periphery"

Signed and Sealed this

*Twenty-third* Day of *July 1985*

[SEAL]

*Attest:*

DONALD J. QUIGG

*Attesting Officer* *Acting Commissioner of Patents and Trademarks*